US006112368A

United States Patent [19]

Luckett

[11] Patent Number: 6,112,368

[45] Date of Patent: Sep. 5, 2000

[54] TEMPERATURE COMPENSATING VALVE

[75] Inventor: Nicholas George Luckett, Wolverhampton, United Kingdom

[73] Assignee: Ingersoll-Rand Architectural Hardware Group Limited, Birmingham, United Kingdom

[21] Appl. No.: 09/197,981

[22] Filed: Nov. 23, 1998

[30] Foreign Application Priority Data

Nov. 27, 1997 [GB] United Kingdom ..... 9724968

[51] Int. Cl.[7] ..... E05F 3/04

[52] U.S. Cl. ..... 16/59; 16/58; 16/49; 16/DIG. 9; 16/DIG. 21; 251/215; 137/315

[58] Field of Search ..... 16/59, 49, 51, 16/71, 79, 86, 52, 57, 58, DIG. 9, DIG. 21; 251/215, 122, 366, 367

[56] References Cited

U.S. PATENT DOCUMENTS

| | | | |
|---|---|---|---|
| 3,747,894 | 7/1973 | Pepper | 251/215 |
| 4,148,111 | 4/1979 | Liebermann . | |
| 4,573,238 | 3/1986 | Phillips . | |
| 4,703,775 | 11/1987 | Pastrone | 251/215 |
| 5,548,263 | 8/1996 | Bulgatz et al. | 335/274 |
| 5,657,790 | 8/1997 | Mohn | 137/614.11 |
| 5,722,636 | 3/1998 | Houston | 251/167 |
| 5,727,776 | 3/1998 | Gerstenberger | 251/368 |
| 5,992,444 | 11/1999 | Junttila | 137/315 |

FOREIGN PATENT DOCUMENTS

| | | | |
|---|---|---|---|
| 35755 | 6/1935 | Netherlands | 251/215 |
| 2227811 | 8/1990 | United Kingdom | 137/315 |

*Primary Examiner*—Anthony Knight
*Assistant Examiner*—Mark Williams
*Attorney, Agent, or Firm*—Michael H. Minns

[57] ABSTRACT

A valve element for operative association with a valve seat in a passage in a body in which the valve element is mounted, in use, the valve element comprising first and second portions connected together by snap-fit means, the first portion being screw-threaded for mounting it in said body, and part of the second portion interrupting said screw-thread of the first portion.

5 Claims, 1 Drawing Sheet

TEMPERATURE COMPENSATING VALVE

BACKGROUND OF THE INVENTION

This invention relates to an improved valve member or element, particularly, though not exclusively, for use in a fluid flow passage in a hydraulic door closer for controlling fluid flow past an associated valve seat therein.

U.S. Pat. No. 4,148,111 discloses a hydraulic door closer in which in a flow return passage thereof is disposed a valve member which cooperates with a valve seat to control the damping effect of the hydraulic fluid as the door closes under the influence of the closer return spring. The valve member is adjustable towards and away from its associated valve seat to vary the rate of fluid flow past said seat.

Moreover to compensate for changes in the temperature of the hydraulic fluid, which can result in its 'thickening' or 'thinning', i.e. an increase or decrease in its viscosity, the valve member is formed as a first portion of relatively dimensionally stable material, and a second portion of material of greater coefficient of thermal expansion. The first portion is typically of metallic material, such as steel, as it is exteriorly screw-threaded for engagement with a complementary interior screw-thread of the flow return passage, whilst the second portion is typically of plastics material such as nylon. The two portions are an interference fit together to provide, in effect, a one-piece composite valve member. With similar types of thermo-compensating valve elements, the two portions are insert molded together, to form the one-piece composite valve member.

One disadvantage of these known one-piece composite valve members is that they are each specifically for use with a particular form of flow passage and valve seat, so that little, if any, inter-changeability of elements is possible. A further more general disadvantage of this type of restrictor/regulator valve member, whether of integral or of composite one-piece form, is the possibility that when it is screw-threadedly engaged in the flow passage, vibration/temperature/pressure can cause it to move angularly in its associated interior screw-thread formed in the passage, and thus self-adjust. This changes the closing time characteristic of the closer and thus necessitates more frequent maintenance of the door closer than would otherwise be necessary.

The foregoing illustrates limitations known to exist in present one-piece composite valve members. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a valve for use with a door closer, the valve comprising: a body part having a threaded portion thereon; and a stem part in snap fitting engagement with the body part.

The foregoing and other aspects will become apparent from the following detailed description of the invention when considered in conjunction with the accompanying drawing FIGURES.

BRIEF DESCRIPTION OF THE DRAWING FIGURES

FIG. 1 is a side view of a valve element of one embodiment of the invention; and FIG. 2 is a similar view to FIG. 1, but at 90° thereto.

DETAILED DESCRIPTION

One object of the invention is to provide an improved valve member.

According to a first aspect of the present invention there is provided a valve element for operative association with a valve seat in a passage in a body in which the valve element is mounted, in use, the valve element comprising first and second portions connected together by snap-fit means, the first portion being screw-threaded for mounting it in said body, and part of the second portion interrupting said screw-thread of the first portion.

Preferably the second portion is made of a material having a different, desirably greater, coefficient of linear expansion than that of the material of the body, and, in one example, also greater than that of the material of the first portion. More preferably, the second portion is made of resilient and/or deformable material.

Conveniently the interruption of the screw-thread comprises a channel extending longitudinally therethrough and in which is received said part of the second portion.

Advantageously a free end of said part of the second portion is formed with a projection received in a recess in said first portion at a position at or adjacent the one of the ends of the screw thread further from the free end of the second portion.

According to a second aspect of the present invention there is provided a closer for a door or other wing including a valve member of said first aspect of the invention.

Figure 1:
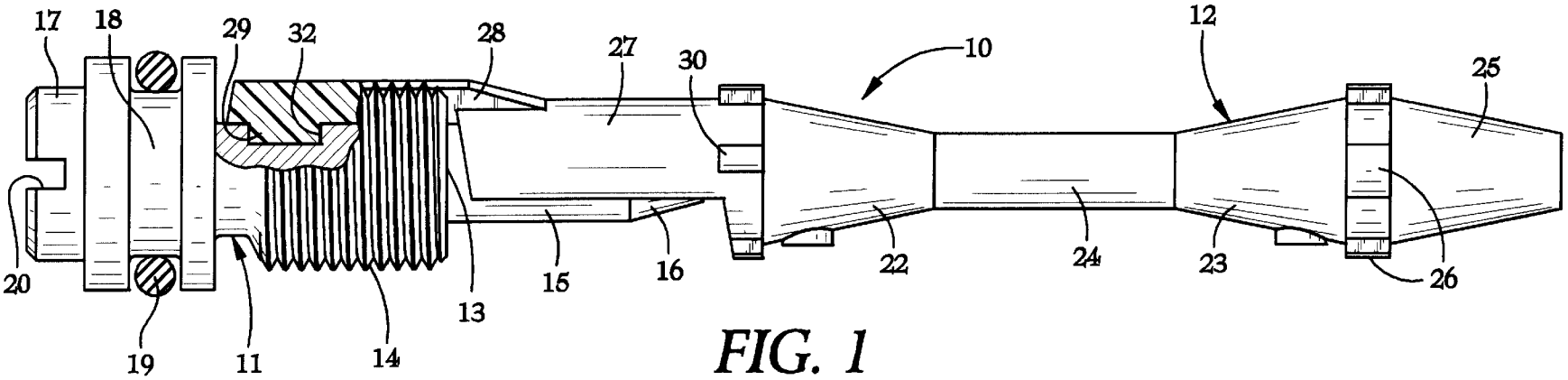
Figure 2:
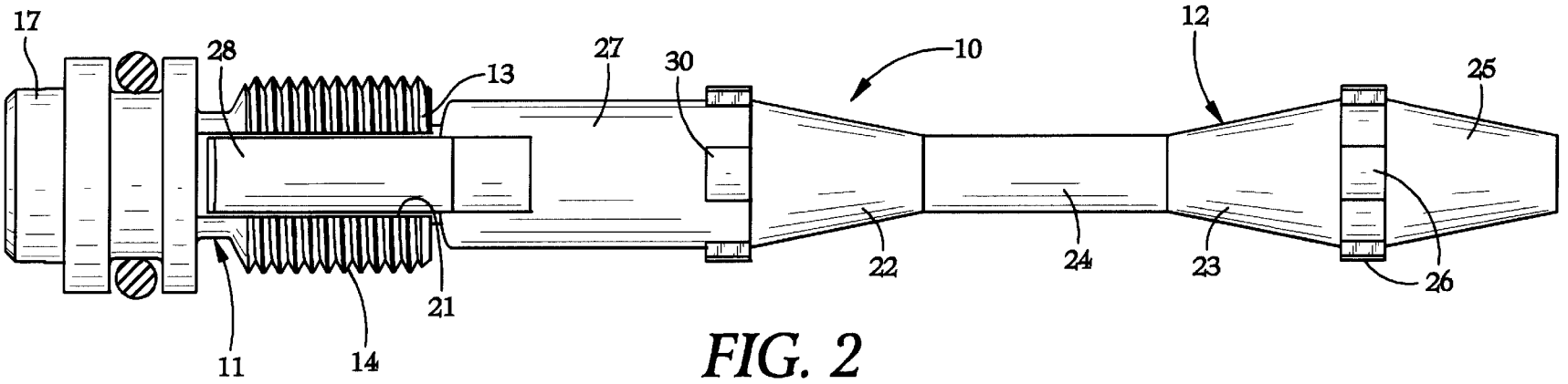

Although a valve element of the present invention can be used as part of various fluid flow control valve arrangements, it has particular application as part of a restrictor/regulator arrangement in a flow passage in a body of a hydraulic door closer device. As is well known with such a device, hydraulic fluid is forced from one side of the spring loaded piston within the body to the other side thereof upon opening of the door, with the spring being compressed, the hydraulic fluid flowing in the opposite direction as the door closes and the spring returns the piston to its rest position. To ensure that the door closes at an acceptable rate, a flow passage between the chambers at respective opposite sides of the piston is normally provided with an adjustable valve element which is operatively associated with a valve seat, so that the rate of closing of the door can be increased or decreased as required by angularly adjusting the valve element so that fluid flow between said element and said valve seat is increased or reduced as required. Accordingly as such a form of closer is well known, this will not be described or illustrated, it being therefore understood that the valve element shown in FIGS. 1 and 2 is intended, in one manner of operation, to perform the usual function of such a valve element in said closer. One such closer is illustrated in U.S. Pat. No. 4,148,111, the disclosure of which is hereby incorporated by reference.

The FIGURES show a valve element 10 of elongated form, the valve element being made up of two main parts, namely a relatively short externally screw-threaded body part 11 and an elongated stem part 12. As will be described hereinafter, the two parts are snap-fitted together and extend generally along a common axis. The body part 11, which is made of a relatively dimensionally stable structural material, normally a metallic material, such as steel, has a cylindrical center portion 13 which is externally screw threaded as indicated by the numeral 14. Extending co-axially from one end of the portion 13 is an elongated stem 15, which is generally cylindrical, but has a frusto-conical free end section 16. Extending from the other end of the portion 13 is a head 17 which defines an annular groove 18 in which is fitted an O-ring seal 19 to seal the valve element 10, in use, in its associated fluid flow passage. The free extremity of the head is slotted, as shown at 20, for engagement, in use, by a blade or the like in order to move the valve element 10 angularly in its flow passage so as to adjust the position of the inner extremity of the valve element 10 relative to its associated valve seat, as will be described hereinafter.

The screw-thread 14 is interrupted through the whole of its longitudinal extent by a rectangular channel 21 which extends longitudinally, and generally in the axial direction of the body part 11 as shown best in FIG. 2. The depth of the channel is such that its base substantially forms a continuation of the adjacent part of the exterior surface of the elongated stem 15. A circular recess 32 is formed in the channel 21 at the end of the screw thread where it is adjacent the head 17. In one example, the channel 21 extends for approximately 45° of arc, but this is not critical. The part 11 alone is utilizable as a valve element, with its elongated stem 15 being equivalent to stem part 12 of the two-part element.

The stem part 12 is made of a material having a substantially greater co-efficient of linear expansion than the material of the body of the door closer in which the valve element 10 is to be used. Normally this will also be a greater co-efficient of linear expansion than the material from which the body part 11 is made. Normally the stem part 12 would be made of plastics material, such a nylon.

The stem part 12 is formed with a pair of coaxial, spaced frusto-conical sections 22, 23 respectively, between which is a reduced diameter circular-section co-axial rod portion 24, each of the sections 22, 23 increasing in diameter in a direction away from the rod portion 24. The section 23 extends to a mirror-image frusto-conical section 25 which thus correspondingly decreases in cross-section to its extremity which constitutes the free end of the part 12 and thus of the valve element 10, the section 25 being that which cooperates, in use, with the valve seat of the passage in which the valve element 10 is received. As shown in the FIGURES, the junction of the sections 23 and 25 can be provided with a plurality of equi-angularly spaced projecting feet 26 there-around.

The section 22 terminates at a matching diameter hollow cylindrical portion which is in fact cut away around approximately 180° to leave a semi-cylindrical portion 27 extending from the larger diameter end of the section 22, the portion 27 extending in the general longitudinal axial direction of the stem part 12. The length of the portion 27 is just slightly greater than the length of the elongated stem 15, with the internal diameter of the portion 27 being dimensioned relative to the external diameter of the elongated stem 15 so that, as will be described, in use, the elongated stem can be snap-fitted into engagement within the portion 27, as shown best in FIG. 1, the material of the stem part 12 being resilient, as previously described. At the end of the portion 27 remote from the section 22, there projects an arm 28, this being disposed at the center of the outer periphery of the portion 27, i.e. at approximately 90° around its outer surface from either free edge thereof. The arm 28 is rectangular in plan, as shown best in FIG. 2 and is of a width, depth and length to enable it to engage snugly in the channel 21 which interrupts the screw-thread 14, the arm being disposed, as shown in FIG. 1, in a plane slightly beyond that containing the surface of the portion 27 from which it extends. As shown in FIG. 1, the arm is disposed in the channel 21 so that its outer surface is substantially flush with the outer surface of the screw threads at opposite sides of the channel 21. At the free end of the arm 28 an inwardly directed protrusion 29 is received within the circular recess 32 at the end of the screw thread adjacent the head, so as to enhance the fitting of the body part 11 to this stem part 12, and resist any longitudinal separation between parts 11 and 12.

A plurality of equi-angularly spaced feet 30, identical to feet 26, are provided at the junction of the section 22 and portion 27.

In use, the valve element 10 is intended to be fitted in a fluid flow passage machined into the body of a conventional hydraulic door closer device. At one end of the passage there is a conventional valve seat, whilst at its outer end, the passage is stepped to accommodate the head as a sealing fit, with part of the passage inwards of the step being internally screw threaded to complement the screw-thread 14 on the body part 11, so that insertion of the valve element 10 involves screwing it into the passage formed in the body of the door closer by engagement of the threads 14 with the internal thread in the passage. As will be appreciated, the extent to which the valve element 10 is screwed into the passage will determine the separation of the section 25 at the end of the stem part 12 from the aforementioned valve seat, and thus the degree of restriction/regulation to flow which the valve element 10 provides. As mentioned, the valve element is adjustable axially by rotating it, this being effected by a blade or the like being engaged in the slot 20. Suitable indication means can be provided at the exterior of the flow passage to show which way the valve element should be turned to decrease or increase flow and thus similarly to speed up or slow down the rate of closure of the door respectively. The feet 26 and 30 help to guide the valve element, particularly to guide the frusto-conical section 25 onto its seat and assist concentricity in section 22 and portion 27, by providing location in the machined drilling in the body in which the valve element is received.

Although described with the embodiment of FIGS. 1 and 2, it is not essential that the two main parts of the valve element are made of respective materials having different coefficients of linear expansion, nor is it essential that one or both of the parts of the valve element is or are of material having a greater coefficient of linear expansion than the body of the door closer. In other words the thermo-compensation aspect of the valve described is not essential to the invention. It is however advantageous, in that the described difference in coefficients of linear expansion will compensate for changes in the ambient temperature, so that a consequent change in the viscosity of the oil or other hydraulic fluid flowing in the flow passage will be compensated for, in the normal well known manner, so that there is automatic, self-adjustment rather than it being necessary manually to adjust the valve element to compensate for temperatures changes. As is thus well known, a rise in the ambient temperature which will 'thin' or increase the viscosity of the oil is compensated for by expansion of the material of the stem part 12 so as to decrease the spacing between the stem part 12 and the valve seat. Similarly for decreasing temperatures, the 'thickening' or decrease in viscosity of the oil will be compensated for by corresponding contraction of the material of the stem part 12 so that the spacing between the stem part 12 and the valve seat will increase in order to maintain the oil flow constant as set by the previous manual adjustment of the valve element 10. It will be appreciated that although the body part 11 would normally be made of metal to provide the required strength, it might be possible for the compensation to be by way of the body part 11 being of plastics material or the like with the stem part being of a material having a lower co-efficient of linear expansion.

One advantage of the valve element of the present invention relates to the snap-fit connection between the two main parts. In contrast to the prior art arrangements referred to in the introduction, the snap-fit arrangement is not only more commercially viable than insert molding as is the current practice in the door closer industry, but it also enables the valve element 10 to be adapted as required for different thermal compensation arrangements merely by changing the snap-on stem part in respect of material and/or size in order to suit differing thermal valve requirements. Thus this arrangement provides the interchangeability which, as mentioned in the introduction, is missing where the valve is formed of two parts which are permanently secured together or which are, in any event, not normally intended for separation.

A further advantage of the present invention relates to the interruption of the screw thread by the arm 28 of the stem part 12. This arm acts as a lock when the body part 11 threadingly engages with the interior threads in the flow passage of the door closer, with the result that transmission of vibration, movement or the like from the body of the closer to the body part 11 is reduced or eliminated. Accordingly the possibility of such vibration or movement causing self-adjustment of the body part 11, and thus the valve element 10, during operational conditions is thus correspondingly reduced or eliminated, thus resulting in low maintenance.

Finally the provision of the mid-section of the stem part 12 in the form of a reduced diameter rod provides a degree of vandal-proofing. With known valve elements in door closers, which elements are of rigid plastics, a slow taper will be forced to lock into its seat if the valve element is forced home, i.e. over-adjusted, by keeping it concentric, usually resulting in the valve being sheared off in the closed position as more force is channeled into the end taper area. With the embodiment described, the midsection, namely the portion 24, deforms if the valve is over tightened onto its valve seat so that the valve is not 'locked' in its closed position. This is because when the portion deforms, it mis-aligns the section 25, such axial displacement helping to prevent said section locking into its seat.

Accordingly, with or without the provision of thermal-compensation, a valve of the present invention is advantageous by way of its snap-fit construction and also by virtue of its anti-vibration transmission feature provided conveniently by a part of the valve stem, this automatically being engaged correctly in position when the snap-fit takes place between the two valve components.

Having described the invention, what is claimed is:

1. A valve for use with a door closer, the valve comprising:

a body part having a threaded portion thereon; and a stem part in snap fitting engagement with the body part, the stem part including an elongated extension portion having a means thereon for retaining the stem part in snap fitting engagement with the body part, wherein the means for retaining comprises the body part threaded portion including a non-threaded groove portion and the stem part elongated extension engaging the non-threaded groove portion.

2. A valve for use with a door closer, the valve comprising:

a body part having a threaded portion thereon; and a stem part in snap fitting engagement with the body part, wherein the body part has an elongated stem portion extending therefrom and the stem part has a semi-circular portion extending axially therefrom, the elongated stem portion fitting within the semi-circular portion when the stem part is in snap fitting engagement with the body part.

3. A valve for use with a door closer, the valve comprising:

a body part having a threaded portion thereon;

a stem part in snap fitting engagement with the body part; and a means for reducing vibration caused movement of the body part.

4. The valve according to claim 3, wherein the means for reducing vibration caused movement of the body part comprises the body part threaded portion including a non-threaded groove portion and the stem part including an elongated extension engaging the non-threaded groove portion.

5. A temperature compensating valve for use with a door closer, the valve comprising a body part having a threaded portion thereon and stem portion coupled to the body part, the stem portion being formed of a material having a thermal coefficient of expansion greater than the thermal coefficient of expansion of the door closer, wherein the improvement comprises the stem part being in snap fitting engagement with the body part, the body part threaded portion including a non-threaded groove portion and the stem part elongated extension engaging the non-threaded groove portion.

* * * * *